US005663500A

United States Patent [19]

Hauner et al.

[11] Patent Number: 5,663,500

[45] Date of Patent: Sep. 2, 1997

[54] SILVER-BASED CONTACT MATERIAL FOR SWITCHGEAR USED IN POWER ENGINEERING

[75] Inventors: Franz Hauner, Röttenbach; Manfred Müller, Amberg; Günter Tiefel, Fürth, all of Germany

[73] Assignee: Siemens Aktiengesellschaft, München, Germany

[21] Appl. No.: 669,463

[22] PCT Filed: Dec. 14, 1994

[86] PCT No.: PCT/DE94/01488

§ 371 Date: Jun. 20, 1996

§ 102(e) Date: Jun. 20, 1996

[87] PCT Pub. No.: WO95/17758

PCT Pub. Date: Jun. 29, 1995

[30] Foreign Application Priority Data

Dec. 20, 1993 [DE] Germany ..... 43 43 550.5

[51] Int. Cl.[6] ..... C22C 5/06

[52] U.S. Cl. ..... 75/232; 75/235; 75/247

[58] Field of Search ..... 252/514, 519, 252/520; 75/247, 235, 232

[56] References Cited

U.S. PATENT DOCUMENTS

| | | | |
|---|---|---|---|
| 4,341,556 | 7/1982 | Bohm et al. | 75/173 A |
| 4,859,238 | 8/1989 | Weise et al. | 75/233 |
| 5,429,656 | 7/1995 | Hauner et al. | 75/232 |
| 5,486,222 | 1/1996 | Hauner | 75/232 |

FOREIGN PATENT DOCUMENTS

| | | |
|---|---|---|
| 42 01 940 | 7/1993 | Germany . |
| WO92/22080 | 12/1992 | WIPO . |

*Primary Examiner*—Ngoclan Mai
*Attorney, Agent, or Firm*—Kenyon & Kenyon

[57] ABSTRACT

Substitute materials are increasingly proposed for contact pieces in low-voltage switches, which until now frequently consisted of silver-nickel. In the case of such a substitute material which, besides silver, contains at least iron oxide ($Fe_2O_3/Fe_3O_4$) and zirconium oxide ($ZrO_2$) as active components, the making capacity with regard to the critical welding current is improved by an addition of a further oxide of the sixth subgroup of the Periodic System and/or of a mixed oxide that consists of iron oxide and the oxide of an element of the sixth subgroup of the Periodic System. In this connection, the further additive is, in particular, ferro-wolframate ($FeWO_4$).

8 Claims, No Drawings

SILVER-BASED CONTACT MATERIAL FOR SWITCHGEAR USED IN POWER ENGINEERING

BACKGROUND OF THE INVENTION

The invention relates to a silver-based contact material for switchgear used in power engineering, in particular for contact pieces in low-voltage switchgear which, besides silver, contains at least iron oxide and zirconium oxide as active components.

Contact materials of the system silver-metal (AgMe), on one hand, and of the system silver-metal oxide (AgMeO), on the other hand, are known for contact pieces in low-voltage switchgear used in power engineering, for example in power circuit-breakers as well as in d.c. contactors and contactor relays. Representatives of the first system are, for example, silver-nickel (AgNi) or silver-iron (AgFe); representatives of the second system are, in particular, silver-cadmium oxide (AgCdO) or silver-tin oxide ($AgSnO_2$). Other metal oxides such as, in particular, bismuth oxide ($Bi_2O_3$), copper oxide (CuO) and/or tantalum oxide ($Ta_2O_5$) can be added to the latter.

The practical usability of a contact material based on silver-metal or silver-metal oxide is determined by the so-called electrical properties spectrum of the contact. Determining characteristics in this connection are, on one hand, the number of operations in a lifetime which is determined by the erosion of the contact member, and, on the other hand, by the so-called excess temperature, i.e. the heating of a contact bridge which results essentially from the electrical resistance of the contact constitution named. In addition, a sufficiently slight welding tendency of the contact pieces and, furthermore, a resistance to corrosion are important since, especially due to long-term corrosion of the material in air-break switchgear, the switching properties can change with time.

From the German laid open print 41 17 311, a contact material is known of the type named at the outset in which iron oxide in percentages by mass between 1 and 50% and an oxide of a further chemical element in percentages by mass between 0.01 and 5% are present in combination as active components. In that case, zirconium oxide, i.a., is named as the further metal oxide. The combination in particular of iron oxide and zirconium oxide has proven to have a favorable spectrum of switching properties.

In many application cases, the latter new material can advantageously replace silver-nickel materials which have been used till now and which in increasing measure are regarded as toxic because of the nickel dust produced during manufacturing and its damaging effects on the human organism. A material especially of the constitution $AgFe_2O_3/Fe_3O_4ZrO_2$, besides being distinguished by low contact heating, stable heating behavior, negligible tendency to weld and long lifetime, is also distinguished in particular by good resistance to corrosion.

SUMMARY OF THE INVENTION

Therefore, the object of the invention is to further improve a material based on silver, iron oxide and zirconium oxide.

The objective is [achieved] according to the invention by an addition of a further oxide of the sixth subgroup of the Periodic System and/or of a mixed oxide which consists of iron oxide and the oxide of an element of the sixth subgroup of the Periodic System. Preferably the additive is a mixed oxide having the elements iron and tungsten, in particular the additive is ferro-wolframate ($FEWO_4$).

DETAILED DESCRIPTION OF THE INVENTION

With regard to the active components, the material according to the invention is characterized preferably by percentages by mass of 1 to 50% iron oxide and 0.1 to 5% zirconium oxide with an addition in percentages by mass of 0.01 to 5% of the further oxide, the remainder being silver. Especially given the addition of ferro-wolframate as the further oxide, in percentages by weight, the material is characterized by 2 to 20% iron oxide, 0.05 to 5% zirconium oxide and 0.01 to 2% ferro-wolframate, the remainder being silver. In this connection, it has turned out that the content of ferro-wolframate in percentages by weight can amount to less than 1%, in particular less than 0.05%.

Tests have revealed that, given contact material according to the invention, the making capacity with regard to the critical welding current is improved. Consequently, expanded application possibilities as silver-nickel substitute materials surprisingly result.

Further advantages and particulars of the invention are revealed by the following description of examples, reference being made in particular to the Table.

Indicated in the Table is the making capacity for a material according to the invention in comparison with the materials of the Prior Art. A 15 kW contactor is used in all cases for measuring.

To produce a contact material $AgFe_2O_35$, $4ZrO_21FeWO_4O$, 4, appropriately weighed-in portions of silver powder, iron oxide powder, zirconium oxide powder and ferro-wolframate powder are mixed. In addition, conventional oxide powders of iron, zirconium and ferro-wolframate are used.

A powder mixture is prepared by wet-mixing the oxide powders. Either strips or wires of the material are produced by extrusion from the power mixture as semi-finished product for contact facings, or else contact pieces are produced directly by means of so-called molding. In both cases, it is advantageous for a reliable joining technique to the contact carrier to produce two-layer strips or two-layer contact pieces having a silver layer on the back side that is able to be soldered.

The concentrations of the individual active components can be varied in producing the material. The so-called mechanical alloying of silver- and individual oxide powders is also possible for producing suitable powder mixtures from silver, iron oxide, zirconium oxide and ferro-wolframate. The structural properties of the finished material are advantageously influenced in this manner.

In the Table, the produced $AgFe_2O_35$, $4ZrO_21FeWO_4O$, 4 material is compared with two materials previously known from the Prior Art. Specified in each case is the critical welding current of the contact materials or the current carrying capacity of the device which was measured under identical boundary conditions on the 15 kW/contactor. The remaining contact properties of the materials correspond to the demands placed for contactor applications.

It is inferable from the Table that a material having the composition $AgFe_2O_35$, $4ZrO_21$ already has a higher critical welding current than the AgNi20 material usually used. If an additive of 0.4% by mass $FeWO_4$ is added to this material, then the making capacity is limited by the current carrying capacity of the device and not by the critical welding current. The critical welding current is increased by at least 20%.

TABLE

| Material | Making Capacity |
|---|---|
| AgNi20 | 500 A critical welding current |
| $AgFe_2O_35$, $4ZrO_21$ | 550 A critical welding current |
| $AgFe_2O_35$, $4ZrO_21FeWO_40$, 4 | 650 A current carrying capacity |

What is claimed is:

1. A silver-based contact material for switchgear used in power engineering, comprising: silver; iron oxide and zirconium oxide ($ZrO_2$) as active components; and an oxide of an element of the sixth subgroup of the Periodic Table or a mixed oxide of iron and an element of the sixth subgroup of the Periodic Table.

2. The contact material according to claim 1, including a mixed oxide of iron and tungsten.

3. The contact material according to claim 2, wherein the mixed oxide is ferro-wolframate ($FeWO_4$).

4. The contact material according to claim 2, comprising: silver; 1 to 50 mass % iron oxide; 0.01 to 5 mass % zirconium oxide; and a total of 0.01 to 5 mass % of an oxide of an element of the sixth subgroup of the Periodic Table or of said mixed oxide.

5. The contact material according to claim 4, comprising: 2 to 20 mass % iron oxide; 0.05 to 5 mass % zirconium oxide; 0.05 to 2 mass % ferro-wolframate ($FeWO_4$); and a balance of silver (Ag).

6. The contact material according to claim 5, wherein the percentage by mass of ferro-wolframate ($FeWO_4$) is less than 1%.

7. The contact material according to claim 6, wherein the percentage by mass of ferro-wolframate ($Fe_3WO_4$) is less than 0.5%.

8. The contact material according to claim 4, which includes both an oxide of an element of the sixth subgroup of the Periodic Table and said mixed oxide, in a total amount of 0.01 to 5 mass %.

* * * * *